US007857672B2

(12) United States Patent
Hong et al.

(10) Patent No.: US 7,857,672 B2
(45) Date of Patent: Dec. 28, 2010

(54) FLOW CONTROL DEVICE FOR IMPROVING PRESSURE RESISTANCE AND HULL VIBRATION

(75) Inventors: Chun Beom Hong, Daejeon (KR); Joon Hwan Bae, Daejeon (KR); Ki Hyun Kim, Daejeon (KR); Sung Mok Ahn, Daejeon (KR); Seung Myun Hwangbo, Daejeon (KR)

(73) Assignee: Samsung Heavy Ind. Co., Ltd. (KR)

( * ) Notice: Subject to any disclaimer, the term of this patent is extended or adjusted under 35 U.S.C. 154(b) by 4 days.

(21) Appl. No.: 12/439,501

(22) PCT Filed: Sep. 3, 2007

(86) PCT No.: PCT/KR2007/004227

§ 371 (c)(1),
(2), (4) Date: Feb. 27, 2009

(87) PCT Pub. No.: WO2008/026903

PCT Pub. Date: Mar. 6, 2008

(65) Prior Publication Data

US 2009/0266286 A1 Oct. 29, 2009

(30) Foreign Application Priority Data

Sep. 1, 2006 (KR) ..... 10-2006-0083991

(51) Int. Cl.
*B63H 1/18* (2006.01)

(52) U.S. Cl. ..... 440/66; 114/288

(58) Field of Classification Search ..... 114/288; 440/66

See application file for complete search history.

(56) References Cited

U.S. PATENT DOCUMENTS 4,631,036 A * 12/1986 Grothues-Spork ..... 440/66

FOREIGN PATENT DOCUMENTS

| | | | |
|---|---|---|---|
| JP | 56063593 | A | 5/1981 |
| JP | 62292592 | A | 12/1987 |
| JP | 8318896 | A | 12/1996 |
| JP | 2002-362485 | A | 12/2002 |

* cited by examiner

*Primary Examiner*—Stephen Avila
(74) *Attorney, Agent, or Firm*—Harness, Dickey & Pierce, P.L.C.

(57) ABSTRACT

A flow control mechanism, for improving pressure resistance and hull vibration, includes a lower fin and an upper fin. The lower fin is disposed between a second station and a fourth station in a length direction of a ship and between 10% and 20% of a design draft from a bottom of the ship in a height direction of the ship, the lower fin being inclined at an angle of 20 to 40 degrees with respect to a design draught (or base) line. The upper fin is disposed between the second station and the fourth station in the length direction of the ship and between 30% and 60% of the design draft from the bottom of the ship in the height direction of the ship, the upper fin being inclined at an angle of 10 to 30 degrees with respect to the design draught (or base) line. Further, an additional fin is disposed between a first station and a third station in the length direction of the ship and between 5% and 20% of the design draft from the bottom of the ship in the height direction of the ship, the additional fin being inclined at an angle of 10 to 40 degrees with respect to the design draught (or base) line.

2 Claims, 9 Drawing Sheets

【Figure 3】
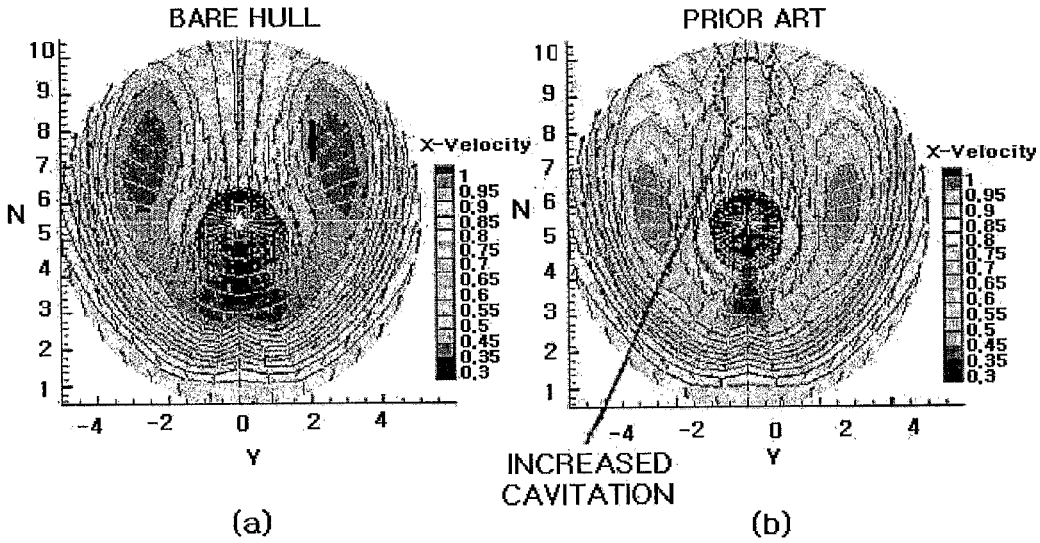

【Figure 4】
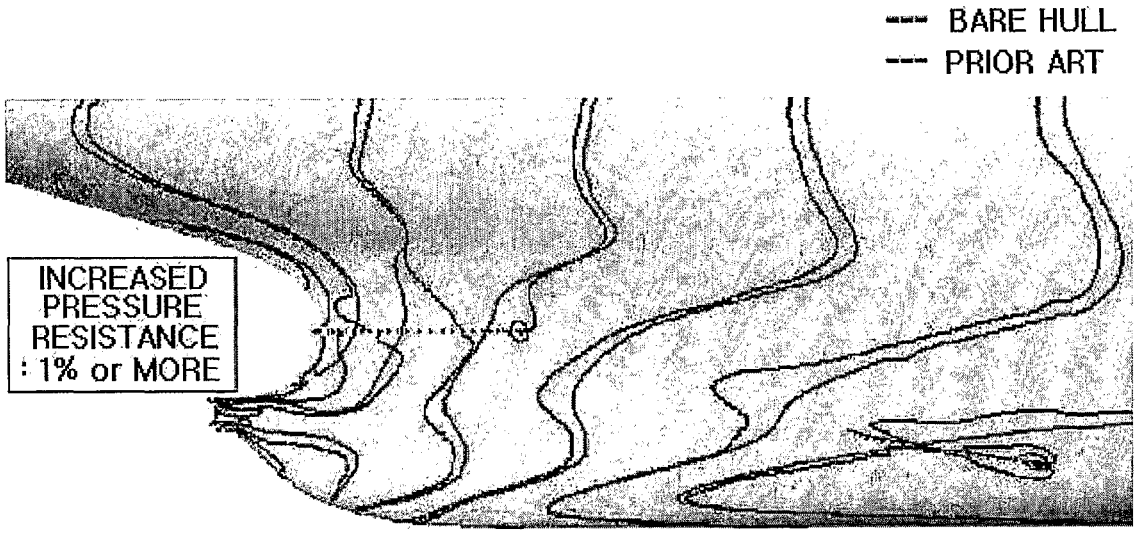

【Figure 5】
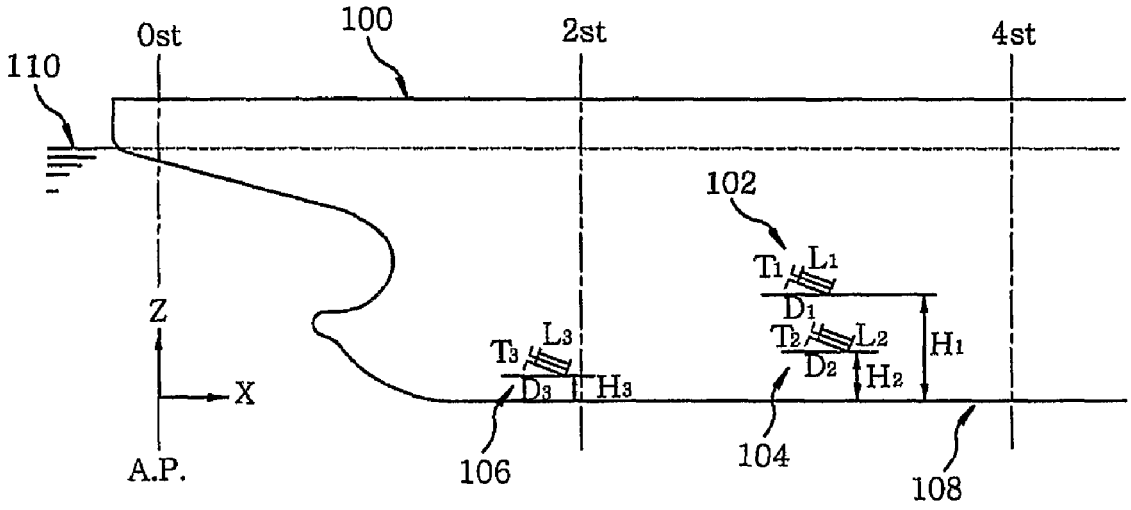

【Figure 6】
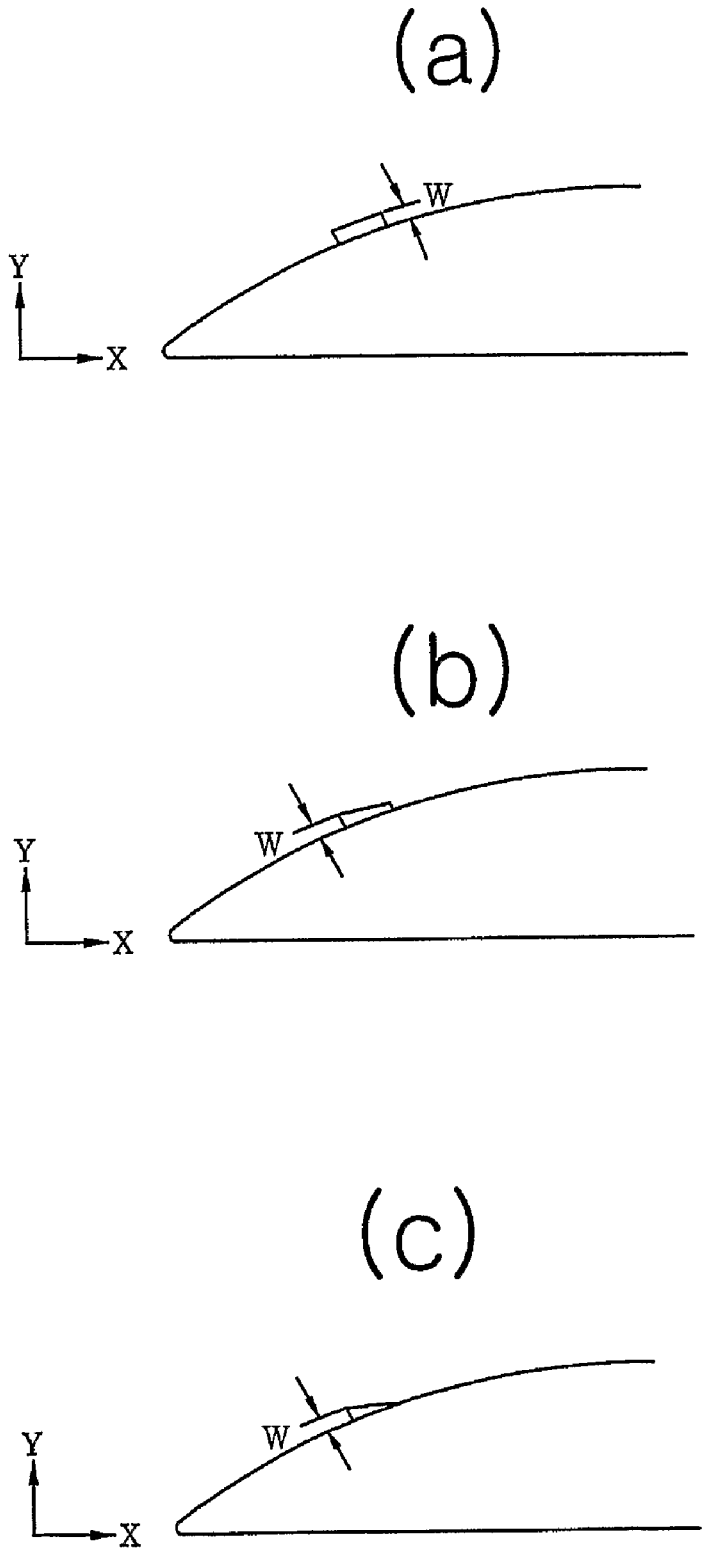

【Figure 7】
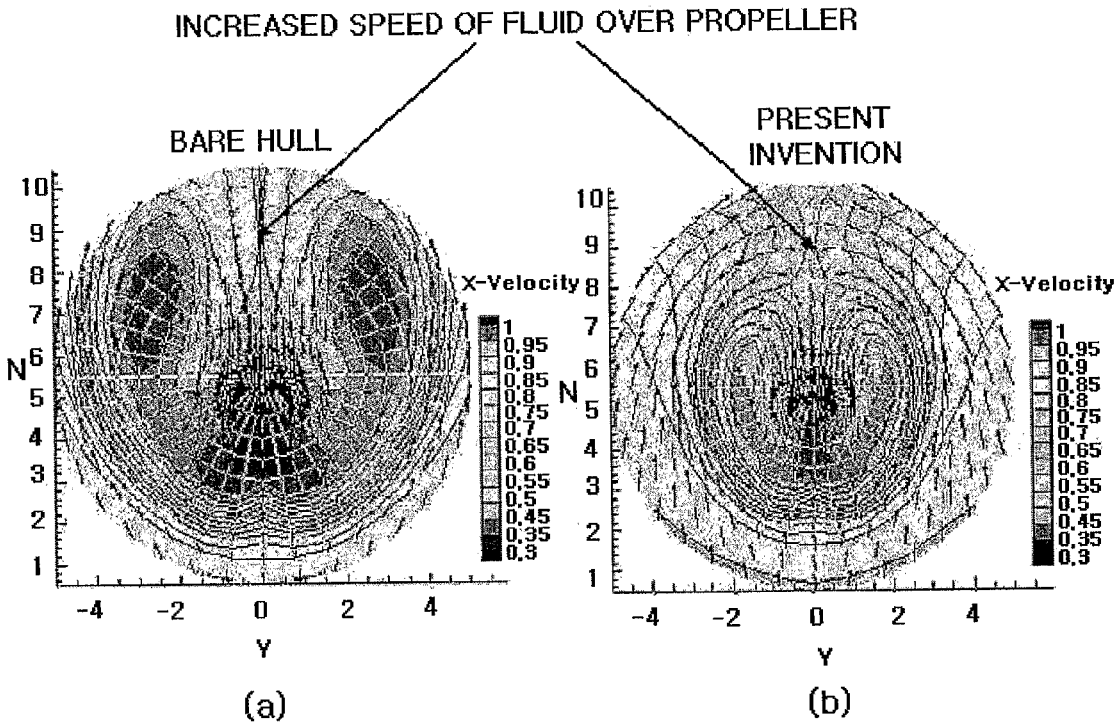

【Figure 8】
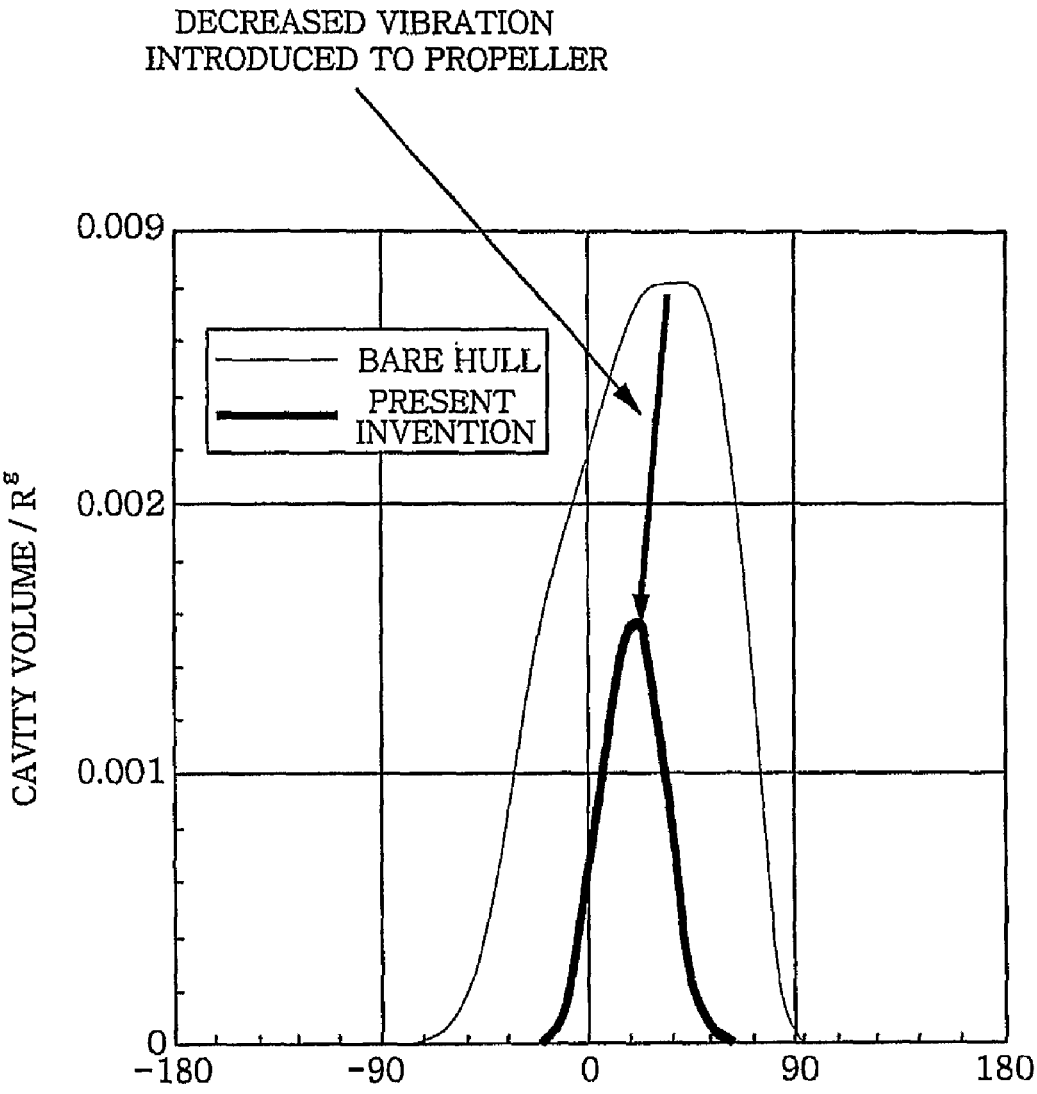

【Figure 9】
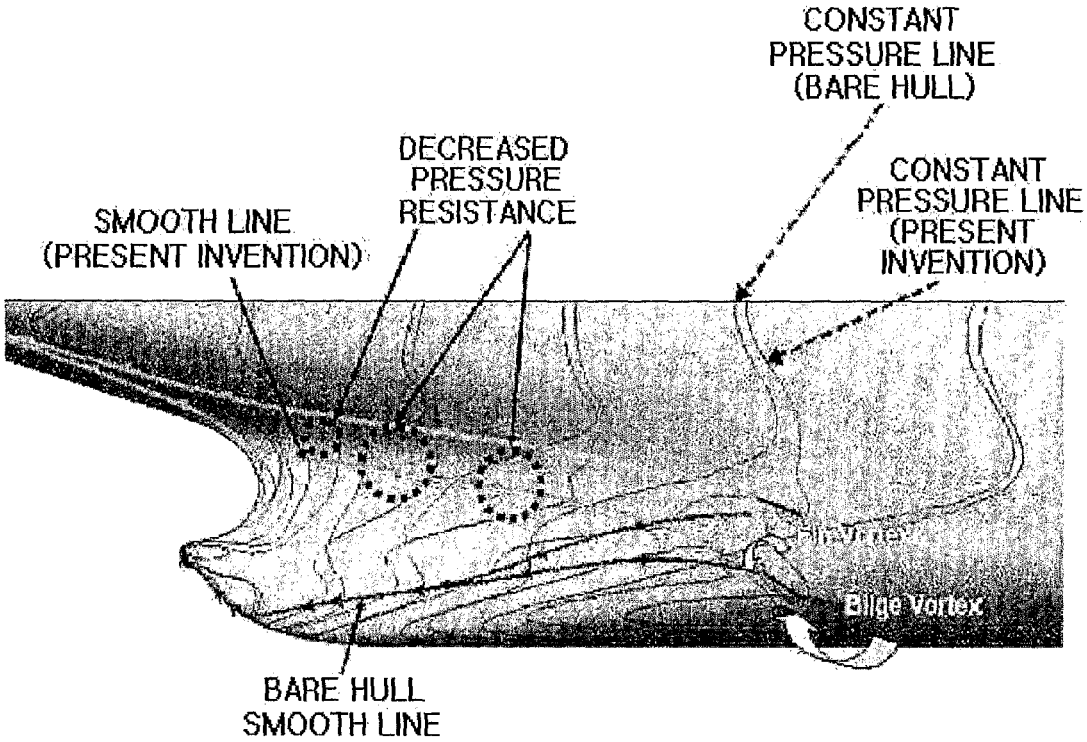

【Figure 10】
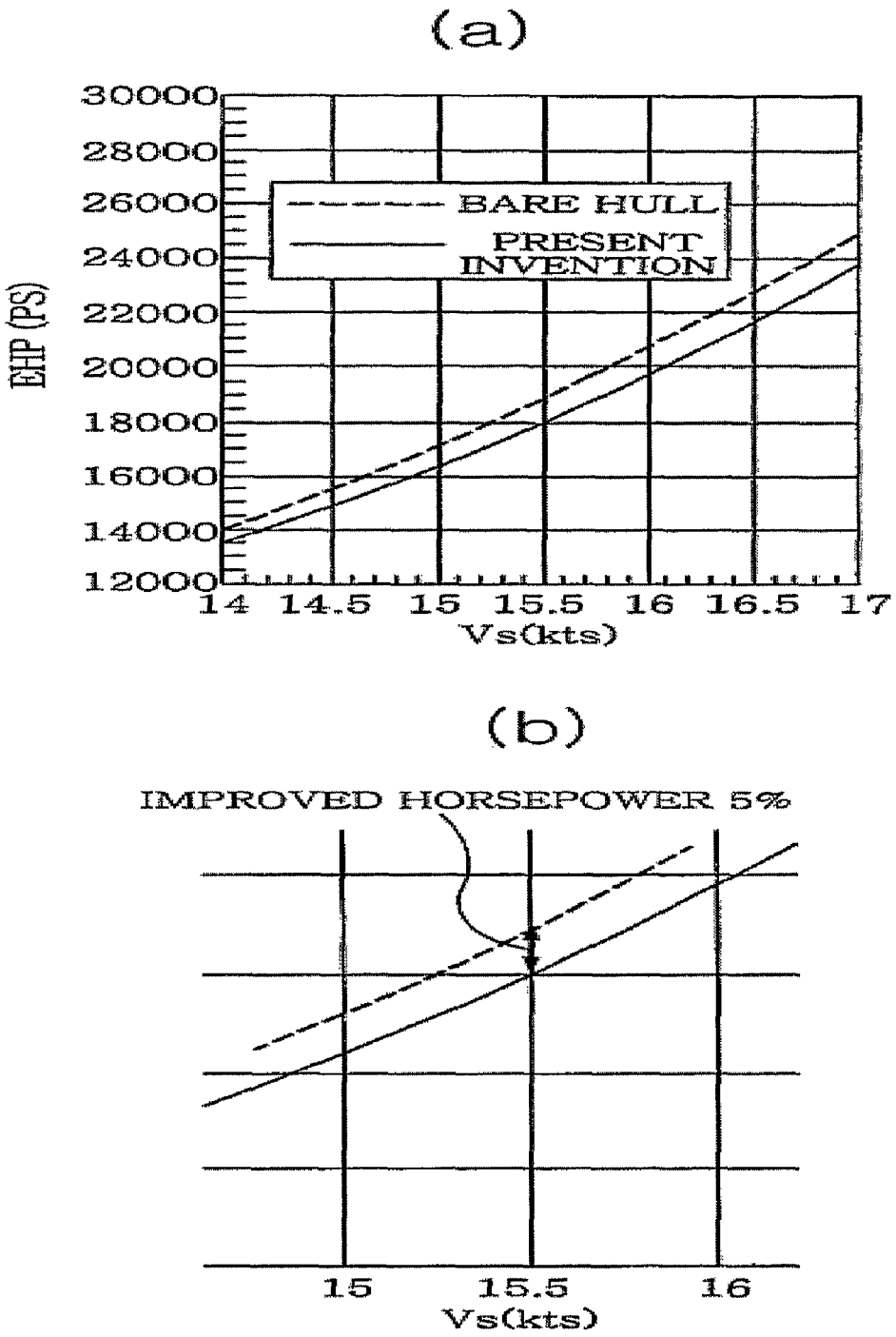

FLOW CONTROL DEVICE FOR IMPROVING PRESSURE RESISTANCE AND HULL VIBRATION

TECHNICAL FIELD

The present invention relates to a flow control mechanism for improving pressure resistance and hull vibration, and more particularly, to a flow control mechanism for improving pressure resistance and hull vibration, which is capable of giving a pleasant voyage environment to crews and passengers of a ship by reducing vibration caused by a ship propeller and enhancing propulsive efficiency of the ship.

BACKGROUND ART

In the present day, freight has been transported rapidly over the world with the development of transportation means such as aircraft. However, in the case of oil, natural gas, vehicles, and containers with a very large freight volume and a heavy freight weight, they could not be transported in great volumes at a time by the aircraft and, therefore, it is common to transport them by a ship.

In the event that freight is transported by using a ship, it is required to make the ship large and move at high speed in order to transport a great amount of freight at a time and rapidly. However, hull vibration is increased by a ship propeller and a lot of fuel is consumed due to an increase of an engine horsepower resulting from the large ship moving at a high speed.

Therefore, there is a need for the development of a device which can reduce hull vibration by the ship propeller and save fuel even when the horsepower of the engine is increased.

FIG. 1 is a schematic side view of a conventional fin device of a ship. FIG. 2 is a schematic side view illustrating the flow of a fluid, which is controlled by the conventional fin device of the ship. FIG. 3 illustrates the comparison of the speed of a fluid flowing into the propeller of the ship provided with the fin device shown in FIG. 1 with the speed of a fluid flowing into the propeller of a bare hull provided with no fin device. FIG. 4 illustrates the comparison of constant pressure lines of the ship provided with the fin device shown in FIG. 1 with constant pressure lines of the bare hull.

The conventional fin device of the ship is disclosed in Japanese Patent Laid-Open Publication No. 2002-362485, and was contrived to improve propulsive efficiency and reduce resistance of a ship body.

The fin device of the ship includes two strap fins 5 and 6 which are respectively provided on the front and rear sides. Both the fins 5 and 6 are mounted to an outer plate of the ship body so as to protrude at an almost right angle, and have a thin thickness.

The front fin 5 has an installation starting point at a location of a distance S (within 15% of Lbp) on the prow side from a vertical line 8 of the stern, and is installed under the central height of a propeller 4. The front fin 5 is inclined such that its height from the bottom of the ship increases as it goes toward the stern. The front fin 5 has a length L1 smaller than the diameter D of the propeller 4. A protruding width of the front fin 5 from the ship body is smaller than 10% of the diameter D of the propeller 4.

The rear fin 6 is disposed in parallel to the bottom of the ship between the centerline of the propeller 4 and a propeller tip, and is installed right ahead of the propeller. The rear fin 6 has a length L2 smaller than the diameter D of the propeller 4.

A protruding width of the rear fin 6 from the ship body is smaller than 20% of the diameter D of the propeller 4.

The front fin 5 serves to weaken a vortex (bilge vortex) 9 which spirals from the bottom of the ship to the side of the ship, and also sequentially guide the vortex toward the propeller. The rear fin 6 serves to prevent diffusion of the bilge vortex 9 which is guided toward the propeller 4 by the front fin 5. The flow of a fluid 10, which flows through a gap between the front fin 5 and the rear fin 6, serves to prevent diffusion of the bilge vortex 9.

If the bilge vortex 9 is weakened as described above, the fluid flown into the propeller becomes more uniform. If diffusion of the bilge vortex 9 is prevented, induction resistance caused by the bilge vortex 9 is decreased. Thus, resistance of the ship body can be reduced and propulsive efficiency of a ship can be improved.

The present inventors performed a numerical analysis in order to confirm the conventional effects. The results of the numerical analysis are shown in FIGS. 3 and 4.

FIG. 3(*a*) shows the speed of a fluid flowing into the propeller of a bare hull provided with no fin device, and FIG. 3(*b*) shows the speed of a fluid flowing into the propeller of a ship provided with the fin device shown in FIG. 1. In FIG. 4, blue color shows the constant pressure lines of the bare hull, and dark color shows the constant pressure lines of the ship provided with the fin device shown in. In FIG. 4, the closer toward the stem, the larger the constant pressure line.

The present inventors set an attachment condition of the fin within a range of the embodiment disclosed in Japanese Patent Laid-Open Publication No. 2002-362485 in performing the numerical analysis.

The front fin 5 was disposed at the location of 15% of Lbp from the perpendicular line A.P. of the stern in the length direction of the ship and mounted at the location of 30% of the diameter of the propeller from the bottom of the ship in the height direction of the ship. Further, the length of the front fin 5 was set to the same as the propeller diameter, the width of the front fin 5 was set to 7% of the propeller diameter, and an angle of the front fin 5 to the bottom of the ship was set to 10 degrees. Furthermore, the rear fin 6 was mounted right in front of the propeller in the length direction of the ship, and at the location of 90% of the propeller diameter from the bottom of the ship in the height direction of the ship. The length of the rear fin 6 was set to 80% of the propeller diameter, the width of the rear fin 6 was set to 10% of the propeller diameter, and the rear fin 6 was set in parallel to the bottom of the ship.

When performing a numerical analysis under the above conditions, it can be seen from FIG. 3 that there is almost at the lower side of the propeller in the speed of a fluid flowing into the propeller of the ship provided with the fin device shown in FIG. 1 compared with the speed of a fluid flowing into the propeller of the bare hull provided with no fin device. It can also be seen that there are speed-reduced portions (portions in which light blue was changed to deep blue) at the upper side of the propeller. It means that the effect of reducing vibration by the propeller rarely appears.

Further, from FIG. 4, it can be seen that the constant pressure lines of the ship provided with the fin device shown in FIG. 1 are almost identical to those of the bare hull and, therefore, pressure resistance is rarely decreased. It can also be seen that propulsive efficiency of the ship is not much improved since pressure resistance is not reduced as described above.

DISCLOSURE OF INVENTION

Technical Problem

It is, therefore, an object of the present invention to provide a flow control mechanism for improving pressure resistance and hull vibration, which is capable of reducing vibration caused by a ship propeller and also resistance of a ship body by preventing a bilge vortex from flowing into the ship propeller, and reducing vibration caused by the ship propeller by accelerating the flow of a fluid flowing into upper and lower sides of the ship propeller.

Technical Solution

In accordance with an aspect of the present invention, there is provided a flow control mechanism for improving pressure resistance and hull vibration, the apparatus including: a lower fin disposed between a second station and a fourth station in a length direction of a ship and between 10% and 20% of a design draft from a bottom of the ship in a height direction of the ship, the lower fin being inclined at an angle of 20 degrees to 40 degrees with respect to a design draught (or base) line; and an upper fin disposed between the second station and the fourth station in the length direction of the ship and between 30% and 60% of the design draft from the bottom of the ship in the height direction of the ship, the upper fin being inclined at an angle of 10 degrees to 30 degrees with respect to the design draught (or base) line.

Preferably, the flow control mechanism further includes an additional fin disposed between a first station and a third station in the length direction of the ship and between 5% and 20% of the design draft from the bottom of the ship in the height direction of the ship, the additional fin being inclined at an angle of 10 degrees to 40 degrees with respect to the design draught (or base) line.

The lower fin generates a new bilge vortex. The new bilge vortex changes the path of a bilge vortex through an interaction with the bilge vortex, preventing the bilge vortex from flowing into the propeller. The new bilge vortex also makes slow the velocity of a fluid over the propeller plane, improving resistance performance. The upper fin and the additional fin accelerate the velocity of a fluid flowing into the propeller, decreasing vibration caused by the propeller. In particular, the upper fin further makes straight a smooth line on the surface of the ship body, helping to improve resistance performance.

The upper fin, the lower fin and the additional fin may be formed in a rectangular, trapezoidal or triangular shape.

Preferably, the upper fin, the lower fin and the additional fin each have a thickness of 20 mm to 100 mm, a width ranging from 0.1% to 0.5% of a ship length, and a length ranging from 0.3% to 3% of the ship length.

In accordance with another aspect of the present invention, there is provided a ship provided with the flow control mechanism as described above.

ADVANTAGEOUS EFFECTS

In accordance with the present invention, vibration caused by the ship propeller can be reduced by only attaching simple fins. Accordingly, a pleasant voyage environment of crews and passengers can be obtained and fuel can be saved through the improvement of propulsive efficiency of the ship.

BRIEF DESCRIPTION OF THE DRAWINGS

The above and other objects and features of the present invention will become apparent from the following description of preferred embodiments given in conjunction with the accompanying drawings, in which:

FIG. 3 illustrates the comparison of the speed of a fluid flowing into a propeller of a ship provided with the fin device shown in FIG. 1 with the speed of a fluid flowing into a propeller of a bare hull provided with no fin device;

FIG. 4 illustrates the comparison of constant pressure lines of the ship provided with the fin device shown in FIG. 1 and constant pressure lines of the bare hull;

FIG. 5 is a schematic side view of a ship provided with a flow control mechanism for improving pressure resistance and hull vibration in accordance with an embodiment of the present invention;

FIG. 6 is a partial plan view of the ship provided with the flow control mechanism shown in FIG. 5;

FIG. 7 illustrates the comparison of the speed of a fluid flowing into a propeller of the ship provided with the flow control mechanism shown in FIG. 5 with the speed of a fluid flowing into a propeller of a bare hull provided with no flow control mechanism;

FIG. 8 illustrates the amount of cavities included in a unit volume, which are changed by the speeds of the fluid shown in FIG. 7;

FIG. 9 illustrates the comparison of constant pressure lines of the ship provided with the flow control mechanism shown in FIG. 5 with constant pressure lines of the bare hull; and FIG. 10 illustrates the comparison of effective horsepower of the ship provided with the flow control mechanism shown in FIG. 5 with effective horsepower of the bare hull.

BEST MODE FOR CARRYING OUT THE INVENTION

Figure 1:
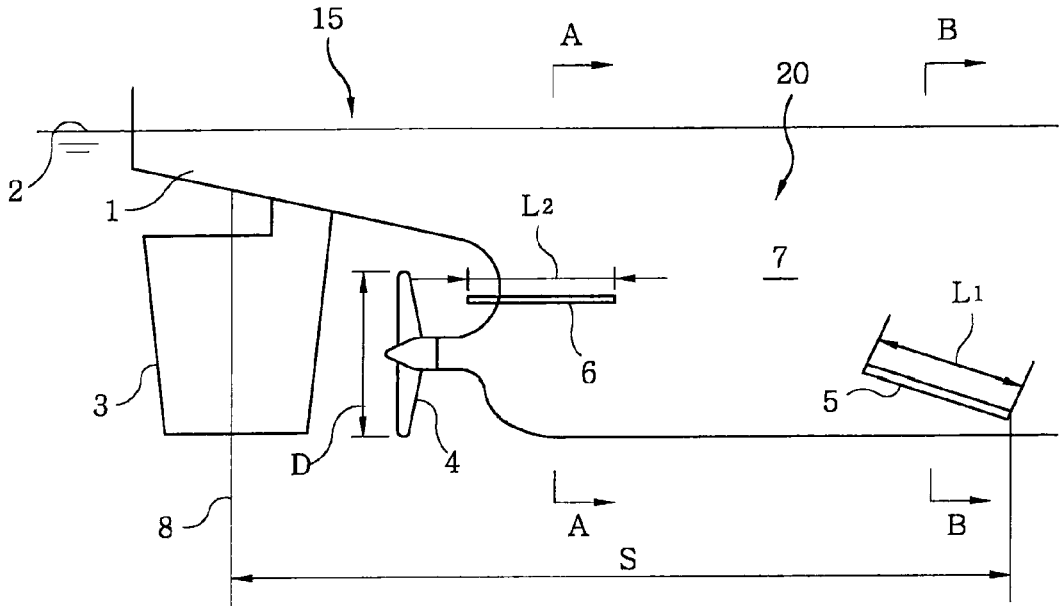
FIG. 1 (PRIOR ART)
FIG. 1 is a schematic side view of a fin device of a conventional ship.

Hereinafter, an embodiment of the present invention will be described in detail with reference to the accompanying drawings.

FIG. 5 is a schematic side view of a ship provided with a flow control mechanism for improving pressure resistance and hull vibration in accordance with an embodiment of the present invention; and FIGS. 6A to 6C are partial plan views of the ship provided with the flow control mechanism shown in FIG. 5.

In the present embodiment, an upper fin 102 is located between a second station and a fourth station in the length direction (X-axis direction) of a ship 100, and at a height H1 between 30% and 60% of a design draft from the bottom 108 of the ship in the height direction (Z-axis direction) of the ship 100. The upper fin 102 is inclined at an angle D1 of 10 to 30 degrees with respect to a design draught (or base) line.

A lower fin 104 is located between the second station and the fourth station in the length direction (X-axis direction) of the ship 100, and at a height H2 between 10% and 20% of the design draft from the bottom 108 of the ship in the height direction (Z-axis direction) of the ship 100. The upper fin 104 is inclined at an angle D2 of 20 to 40 degrees with respect to the design draught (or base) line.

An additional fin 106 is located between a first station and a third station in the length direction (X-axis direction) of the ship 100, and at a height H3 between 5% and 20% of the design draft from the bottom 108 of the ship in the height direction (Z-axis direction) of the ship 100. The upper fin 106 is attached at an angle D3 of 10 to 40 degrees with respect to the design draught (or base) line.

In this case, the term station refers to a boundary between sections in case a LBP is divided into twenty sections equally. Numbers are assigned beginning with a stern portion. The number of the first station is 0 and the number of the last station is 20. The LBP refers to a distance between a forward perpendicular line and a aft perpendicular line. The forward perpendicular line F.P refers to an imaginary line passing through an intersection point between a design perpendicular line and the front of the stem and is perpendicular to the design perpendicular line. The aft perpendicular line A.P refers to an imaginary vertical line passing through an intersection point between the back of a rudder post and a design perpendicular line in case of a shop having the rudder post, or an imaginary vertical line passing through an intersection point between the center line of a rudder stock and a design perpendicular line in case of a ship having no rudder post.

The upper fin 102, the lower fin 104, and the additional fin 106 are formed in a rectangular, trapezoidal or triangular shape, and they may have the same shape or different shapes. They are attached to both sides of the ship in a symmetrical manner.

Thickness T1, T2, and T3 of the upper fin 102, the lower fin 104 and the additional fin 106 each range from 20 mm to 100 mm. The upper fin 102, the lower fin 104 and the additional fin 106 have a width in a range from 0.1% to 0.5% of the length of the ship 100. Lengths L1, L2, and L3 of the upper fin 102, the lower fin 104 and the additional fin 106 each range from 0.3% to 3% of the ship 100. In this case, the width refers to the height of the fins 102, 104, and 106 protruding from the surface of the ship body.

The upper fin 102 serves to accelerate the flow of a fluid flowing into an upper portion of the propeller, and the additional fin 106 serves to accelerate the flow of a fluid flowing into a lower portion of the propeller. In particular, the additional fin 106 serves to make straight a smooth line on the surface of the ship body, helping to improve resistance performance. If the flow of the fluid flowing into the propeller becomes fast, a cavity phenomenon (cavitation) is less generated in the blades of the propeller. Thus, fluctuating pressure of the ship body is decreased and vibration of the ship body is reduced accordingly. The cavitation phenomenon refers to a phenomenon in which surrounding pressure drops below a steam pressure at a specific temperature and a liquid state is changed to a gaseous state.

The lower fin 104 has an angle greater than a flow angle of the smooth line with respect to the bottom of the ship 108, thus generating a vortex. The vortex interacts with a vortex that spirals from the bottom of the ship to the side thereof (i.e., a bilge vortex), guiding the bilge vortex to flow upwardly above the propeller. Thus, the bilge vortex is not flown into the propeller side. If the bilge vortex (i.e., an unstable vortex) is not flown into the propeller blades, slipstream in the propeller blades becomes uniform and fluctuating pressure of the ship body can be reduced, decreasing vibration of the ship body.

Further, the bilge vortex, guided to the upper portion of the propeller by the lower fin 104, serves to make slow the velocity of a fluid flowing through the upper portion of the propeller, increasing a pressure in the upper portion of the propeller. The increased pressure in the upper portion of the propeller functions as force to propel the ship body forwardly. Consequently, pressure resistance of the ship body is decreased.

FIG. 7 illustrates the comparison of the speed of a fluid flowing into a propeller of the ship provided with the flow control mechanism shown in FIG. 5 with the speed of a fluid flowing into a propeller of a bare hull provided with no flow control mechanism; FIG. 8 illustrates the amount of cavities included in a unit volume, which are changed by the speeds of the fluid shown in FIG. 7; FIG. 9 illustrates the comparison of constant pressure lines of the ship provided with the flow control mechanism shown in FIG. 5 with constant pressure lines of the bare hull; and FIGS. 10A and 10B illustrates the comparison of effective horsepower of the ship provided with the flow control mechanism shown in FIG. 5 with effective horsepower of the bare hull.

The present inventors have performed a simulation test in a towing tank in order to demonstrate the effects of the present embodiment. In the simulation test, the block coefficient of a ship was set to 0.81. The upper fin 102 was attached to the third station in the X-axis direction and placed at a height, which is 40% of the design draft from the bottom of the ship 108 in the Z-axis direction, and inclined at an angle of 18.5 degrees with respect to the design draught (or base) line. Further, the lower fin 104 was attached to the third station in the X-axis direction and placed at a height, which is 15% of the design draft from the bottom of the ship 108 in the Z-axis direction, and inclined at an angle of 32 degrees with respect to the design draught (or base) line. The additional fin 106 was attached to the second station in the X-axis direction and placed at a height, which is 10% of the design draft from the bottom of the ship 108 in the Z-axis direction, and inclined at an angle of 23 degrees with respect to the design draught (or base) line. The fins 102, 104, and 106 were formed in a rectangular shape, lengths L1, L2 and L3 thereof were respectively set to 1% of the LBP, and a width W thereof was set to 0.2% of the LBP.

The results of the simulation test and a numerical analysis under the above conditions are shown in FIGS. 7 to 10.

FIG. 7 illustrates the axial velocity distribution of a fluid flowing into the propeller. FIG. 7(*a*) shows an example of a bare hull provided with no flow control mechanism, and FIG. 7(*b*) shows an example of a ship provided with the flow control mechanism of the present embodiment.

When comparing FIGS. 7(*a*) and 7(*b*), it can be seen that the velocity of a fluid flowing into the upper portion of the propeller is indicated by blue color and sky blue in a range of 0.4 to 0.5 in FIG. 7(*a*), whereas the velocity of a fluid flowing into the propeller is indicated by green color and yellow color in a range of 0.65 to 0.85 in FIG. 7(*b*). It can also be seen that a portion in which the velocity of the fluid flowing into the lower portion of the propeller is indicated by green color in FIG. 7(*a*) is changed to orange color in FIG. 7(*b*), so that the velocity of the fluid becomes fast from 0.7 to 0.9.

If the velocity of the fluid flowing into the propeller becomes fast as described above, vibration caused by the propeller is decreased. The results are shown in FIG. 8.

In FIG. 8, a horizontal axis indicates a rotation angle in a clockwise direction (a positive value) on the basis of the 12 o clock direction and a rotation angle in a counterclockwise direction (a negative value) when the propeller is viewed from the back of the ship body, and a vertical axis indicates cavities included in a unit volume.

In FIG. 8, a yellow line (thin line) corresponds to a value in case of the bare hull and a yellowish green line (thick line) corresponds to a value in case of the present embodiment. From the two values, it can be seen that the amount of cavities included in the unit volume is less in the case of the present embodiment than in the case of the bare hull. If the amount of the cavities is decreased, vibration due to the propeller is reduced. Consequently, it can be understood that vibration caused by the propeller is reduced in the case of the present embodiment than in the case of the bare hull.

FIG. 9 illustrates constant pressure lines on the surface of the ship body. In FIG. 9, blue color corresponds to constant pressure lines in the case of the present embodiment, and blue color corresponds to constant pressure lines in the case of the bare hull. As the constant pressure line approaches the stern, it has a greater value.

From FIG. 9, it can be seen that, with respect to a point, a pressure at the point is greater in the case of the present embodiment than in the case of the bare hull. Portions where the difference between the two cases is significantly great are indicated by circular dotted lines.

If the pressure at the rear of the ship body increases, the pressure functions as force to push the ship toward the prow. Consequently, there is an effect of reducing pressure resistance. If pressure resistance is decreased as described above, propulsive efficiency of the ship can be improved. The results are shown in FIG. 10.

FIGS. 10A and 10B illustrate effective horsepower of a ship. In FIGS. 10A and 10B, a horizontal axis indicates the speed of the ship, a vertical axis indicates effective horsepower of the ship, a solid line indicates an example of the present embodiment, and a dotted line indicates an example of the bare hull.

From FIGS. 10A and 10B, it can be seen that in order to move forward the ship at a speed of about 15.5 knots, horsepower of 18000 PS is needed in the case of the present embodiment, whereas horsepower of 19000 PS is needed in the case of the bare hull. In other words, it could be seen that effective horsepower of about 5% was improved.

In accordance with the present invention, vibration caused by the ship propeller can be reduced by only attaching simple fins. Accordingly, a pleasant voyage environment of crews and passengers can be obtained and fuel can be saved through the improvement of propulsive efficiency of the ship.

While the invention has been shown and described with respect to the preferred embodiments, it will be understood by those skilled in the art that various changes and modifications may be made without departing from the spirit and scope of the invention as defined in the following claims.

The invention claimed is:

1. A flow control device for improving pressure resistance and hull vibration, the apparatus comprising:

a lower fin disposed between 10% and 20% from an after perpendicular line in a length direction of a ship and between 10% and 20% of a design draft from a bottom of the ship in a height direction of the ship, the lower fin being inclined at an angle of 20 degrees to 40 degrees with respect to a design draught (or base) line;

an additional fin disposed between 5% and 15% from the after perpendicular line in the length direction of the ship and between 5% and 20% of the design draft from the bottom of the ship in the height direction of the ship, the additional fin being inclined at an angle of 10 degrees to 40 degrees with respect to the design draught (or base) line; and an upper fin disposed between 10% and 20% from the after perpendicular line in the length direction of the ship and between 30% and 60% of the design draft from the bottom of the ship in the height direction of the ship, the upper fin being inclined at an angle of 10 degrees to 30 degrees with respect to the design draught (or base) line;

wherein the upper fin, the lower fin and the additional fin are formed in a rectangular, trapezoidal or triangular shape; and wherein the upper fin, the lower fin and the additional fin each have a thickness of 20 mm to 100 mm, a width ranging from 0.1% to 0.5% of a ship length, and a length ranging from 0.3% to 3% of the ship length.

2. A ship comprising the flow control device described in claim 1.

* * * * *

UNITED STATES PATENT AND TRADEMARK OFFICE

CERTIFICATE OF CORRECTION

PATENT NO. : 7,857,672 B2
APPLICATION NO. : 12/439501
DATED : December 28, 2010
INVENTOR(S) : Hong et al.

It is certified that error appears in the above-identified patent and that said Letters Patent is hereby corrected as shown below:

Delete Patent number 7,857,672 in its entirety and insert Patent number 7,857,672 in its entirety as attached.

Signed and Sealed this
Twenty-first Day of August, 2012

David J. Kappos

David J. Kappos
*Director of the United States Patent and Trademark Office*

(12) United States Patent
Hong et al.

(10) Patent No.: US 7,857,672 B2
(45) Date of Patent: Dec. 28, 2010

(54) FLOW CONTROL DEVICE FOR IMPROVING PRESSURE RESISTANCE AND HULL VIBRATION

(75) Inventors: Chun Beom Hong, Daejeon (KR); Joon Hwan Bae, Daejeon (KR); Ki Hyun Kim, Daejeon (KR); Sung Mok Ahn, Daejeon (KR); Seung Myun Hwangbo, Daejeon (KR)

(73) Assignee: Samsung Heavy Ind. Co., Ltd. (KR)

( * ) Notice: Subject to any disclaimer, the term of this patent is extended or adjusted under 35 U.S.C. 154(b) by 4 days.

(21) Appl. No.: 12/439,501

(22) PCT Filed: Sep. 3, 2007

(86) PCT No.: PCT/KR2007/004227

§ 371 (c)(1),
(2), (4) Date: Feb. 27, 2009

(87) PCT Pub. No.: WO2008/026903

PCT Pub. Date: Mar. 6, 2008

(65) Prior Publication Data

US 2009/0266286 A1 Oct. 29, 2009

(30) Foreign Application Priority Data

Sep. 1, 2006 (KR) ..... 10-2006-0083991

(51) Int. Cl.
*B63H 1/18* (2006.01)

(52) U.S. Cl. ..... 440/66; 114/288

(58) Field of Classification Search ..... 114/288; 440/66

See application file for complete search history.

(56) References Cited

U.S. PATENT DOCUMENTS 4,631,036 A * 12/1986 Grothues-Spork ..... 440/66

FOREIGN PATENT DOCUMENTS

| | | | |
|---|---|---|---|
| JP | 56063593 | A | 5/1981 |
| JP | 62292592 | A | 12/1987 |
| JP | 8318896 | A | 12/1996 |
| JP | 2002-362485 | A | 12/2002 |

* cited by examiner

*Primary Examiner* — Stephen Avila

(74) *Attorney, Agent, or Firm* — Harness, Dickey & Pierce, P.L.C.

(57) ABSTRACT

A flow control mechanism, for improving pressure resistance and hull vibration, includes a lower fin and an upper fin. The lower fin is disposed between a second station and a fourth station in a length direction of a ship and between 10% and 20% of a design draft from a bottom of the ship in a height direction of the ship, the lower fin being inclined at an angle of 20 to 40 degrees with respect to a design draught (or base) line. The upper fin is disposed between the second station and the fourth station in the length direction of the ship and between 30% and 60% of the design draft from the bottom of the ship in the height direction of the ship, the upper fin being inclined at an angle of 10 to 30 degrees with respect to the design draught (or base) line. Further, an additional fin is disposed between a first station and a third station in the length direction of the ship and between 5% and 20% of the design draft from the bottom of the ship in the height direction of the ship, the additional fin being inclined at an angle of 10 to 40 degrees with respect to the design draught (or base) line.

2 Claims, 9 Drawing Sheets

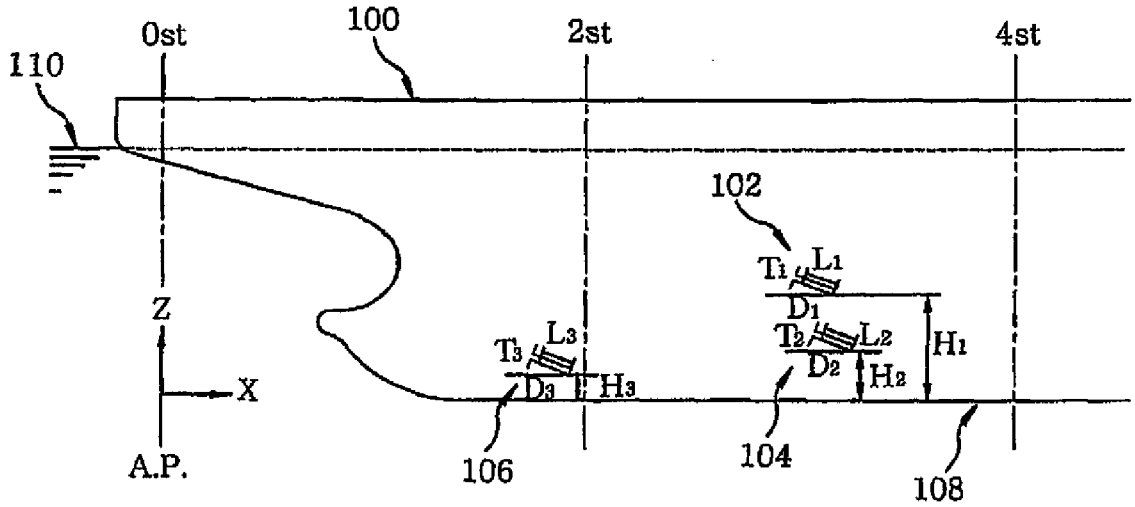

【Figure 3】
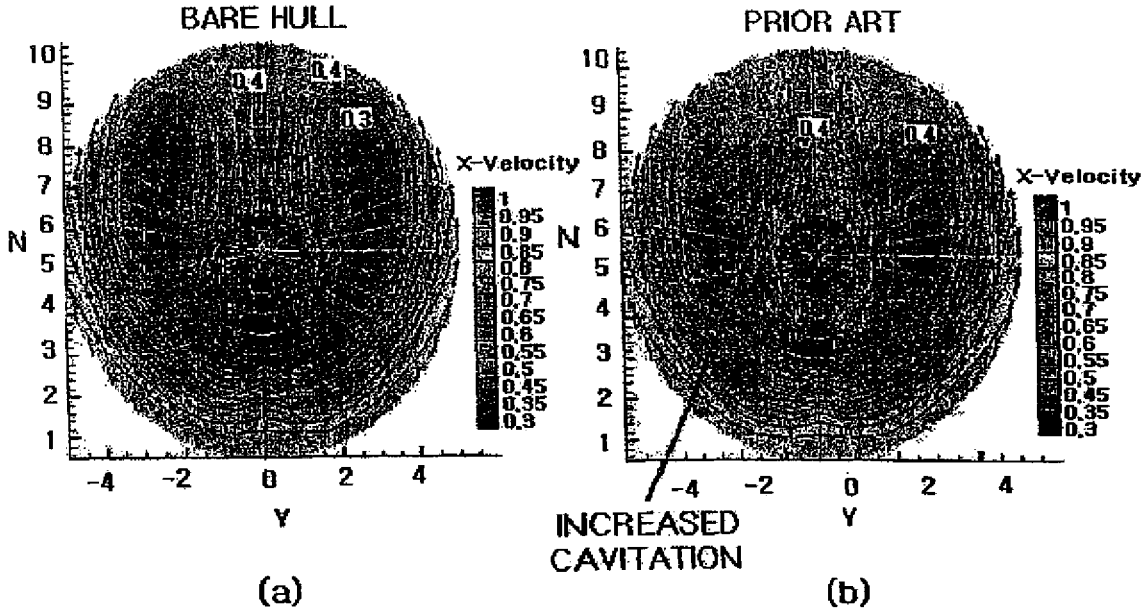

【Figure 4】
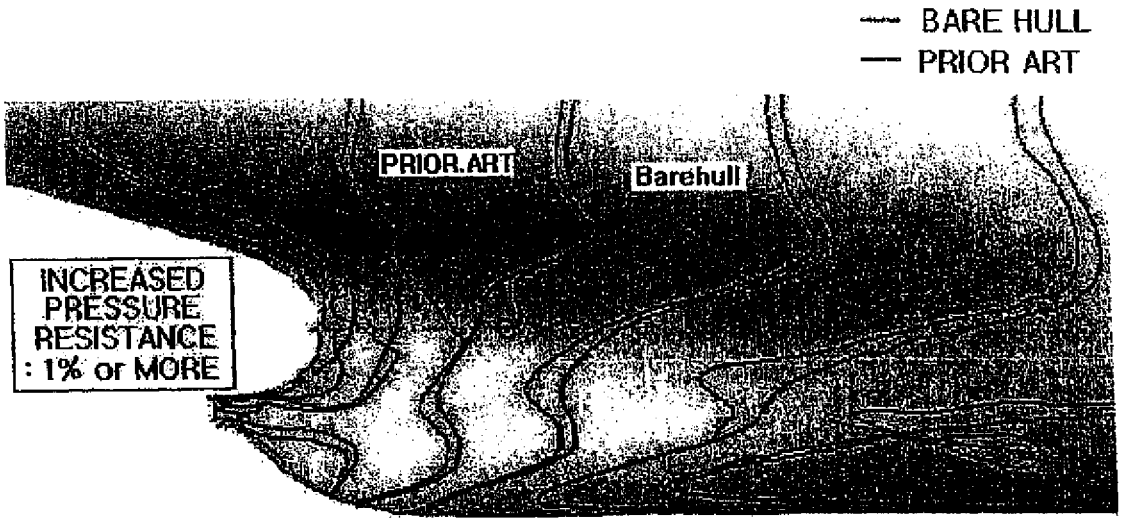

【Figure 5】
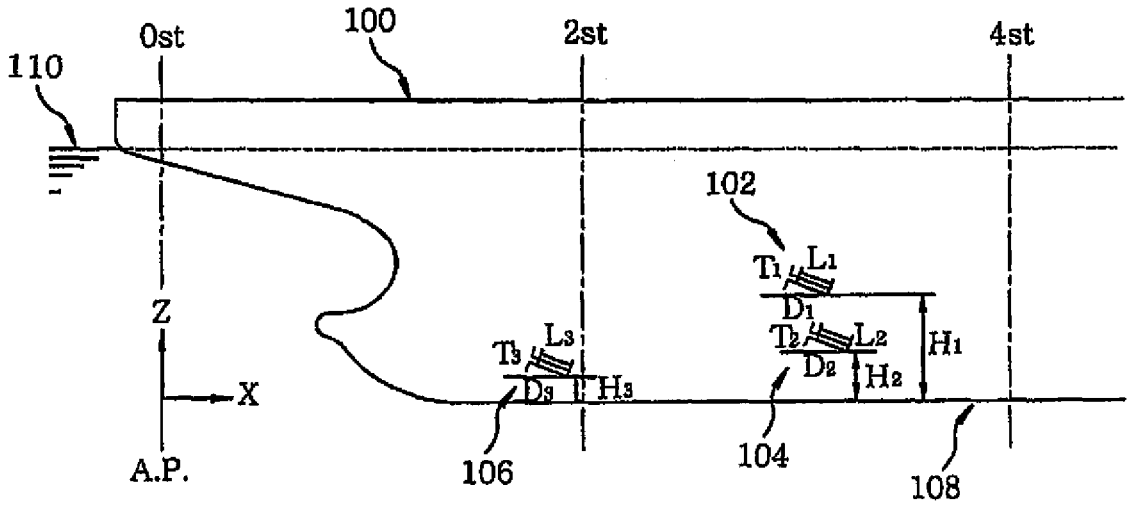

【Figure 6】
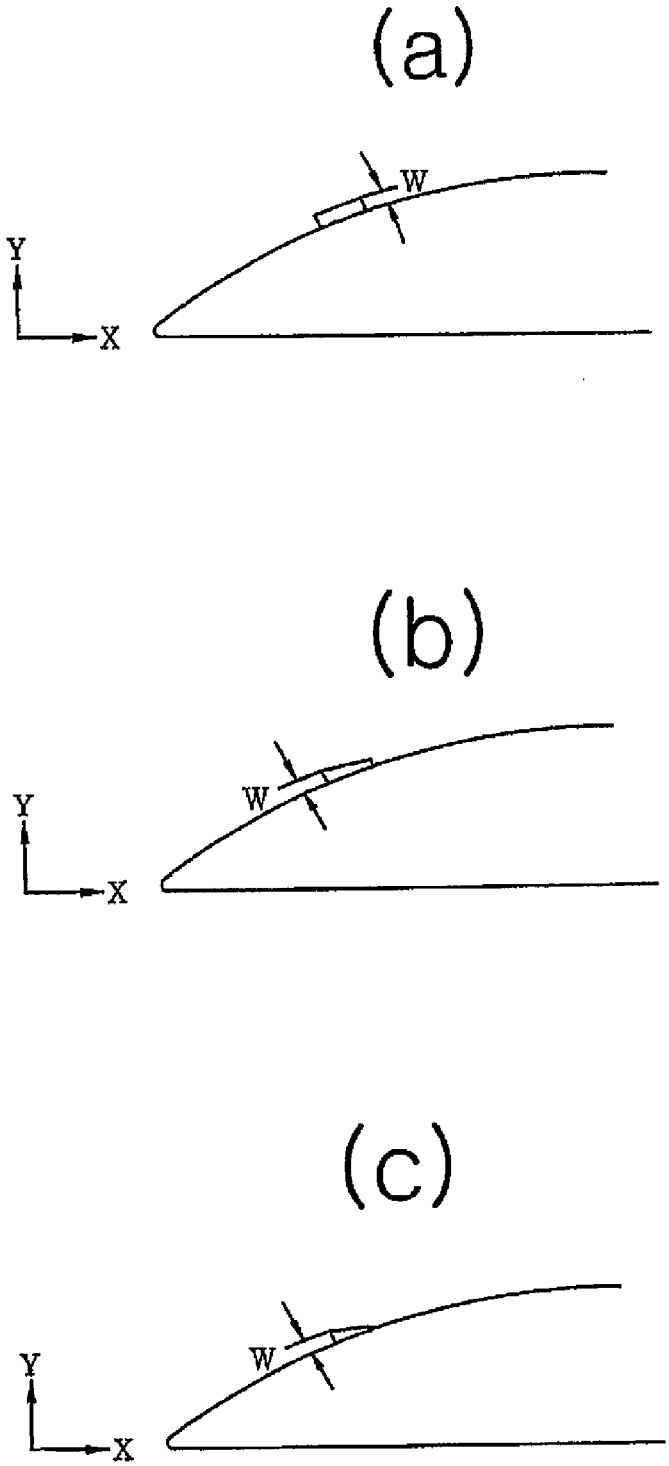

【Figure 7】
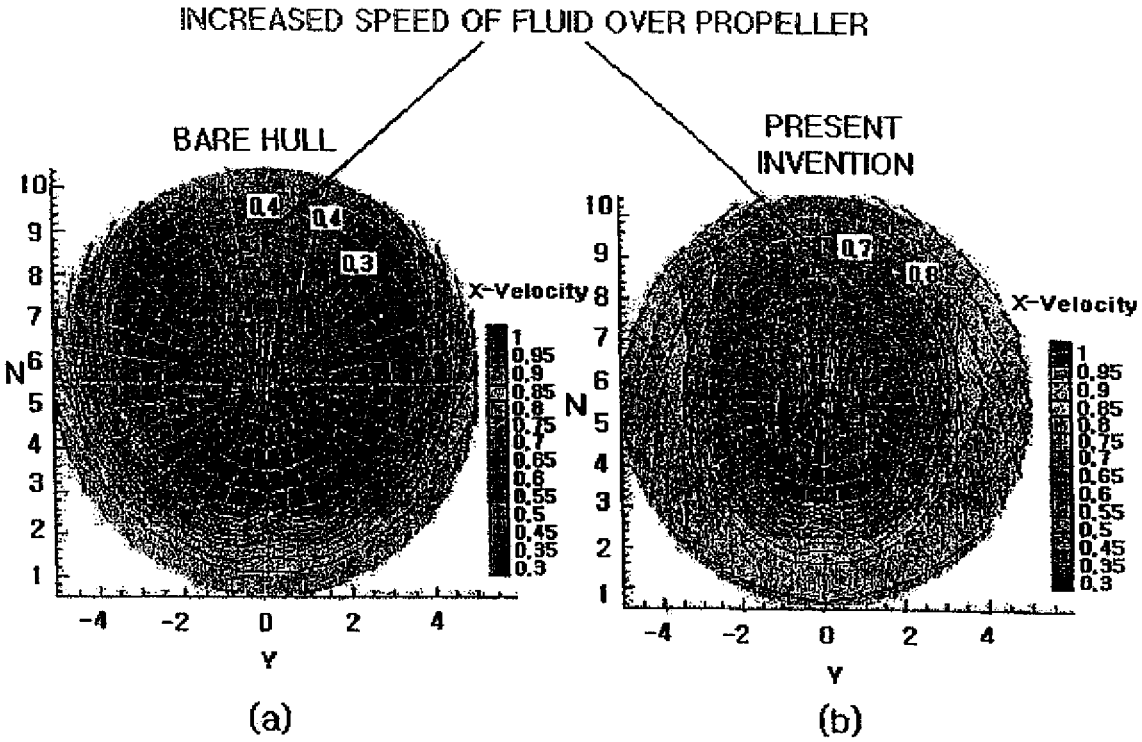

【Figure 8】
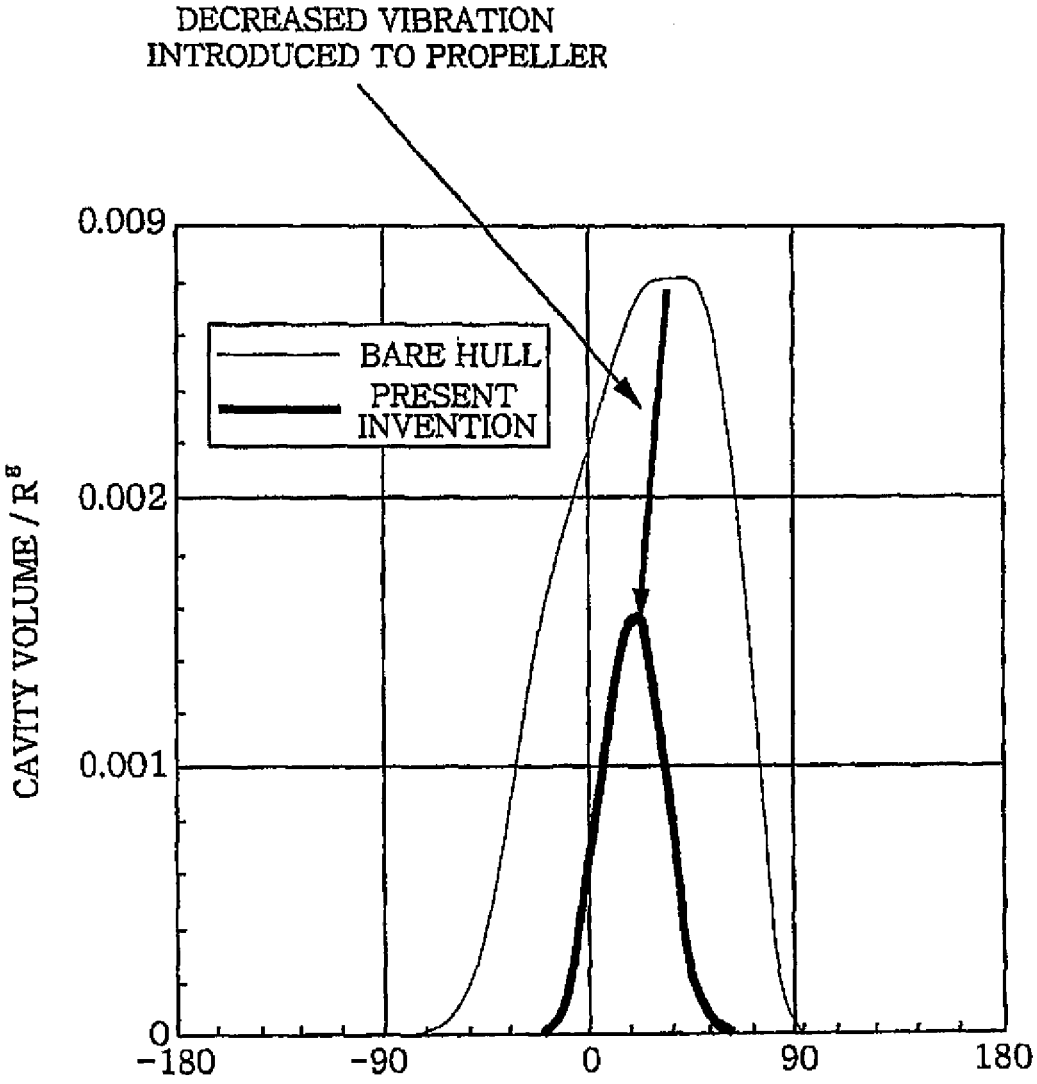

[Figure 9]
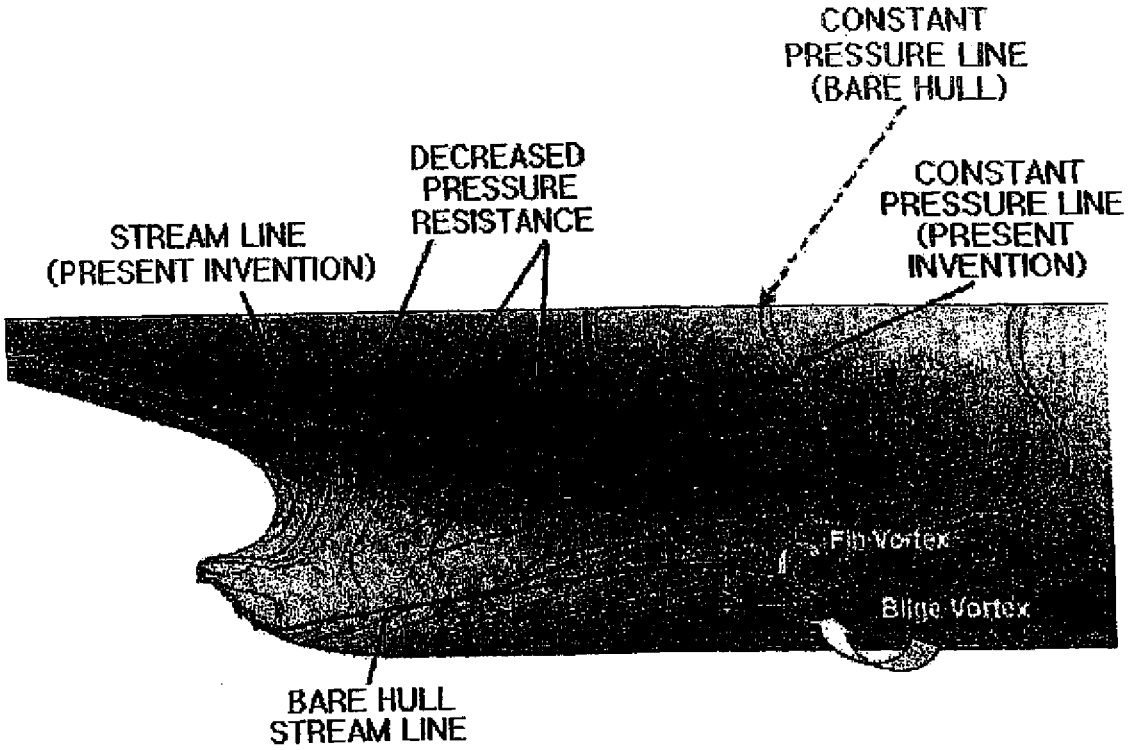

【Figure 10】
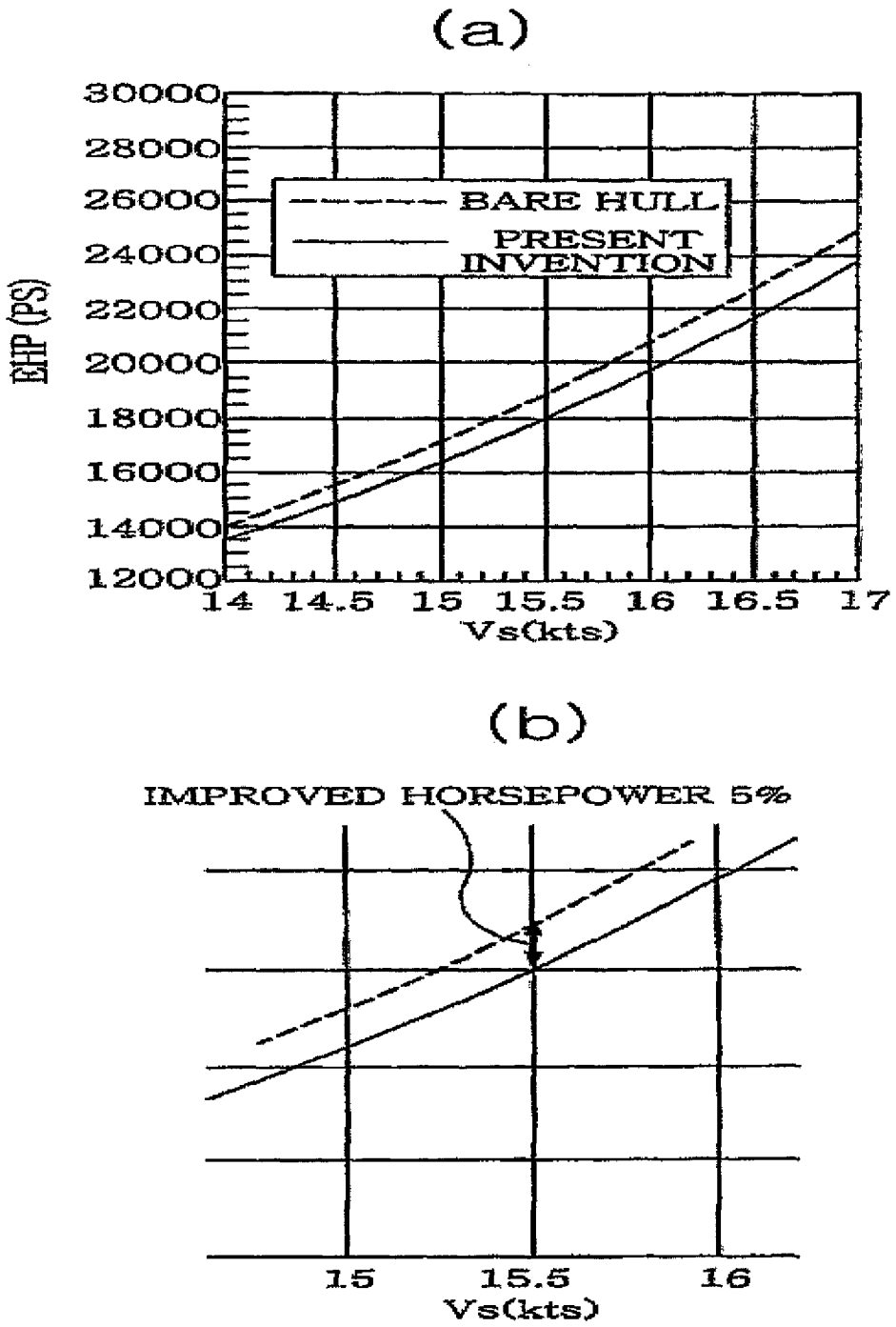

FLOW CONTROL DEVICE FOR IMPROVING PRESSURE RESISTANCE AND HULL VIBRATION

TECHNICAL FIELD

The present invention relates to a flow control device for improving pressure resistance and hull vibration, and more particularly, to a flow control device for improving pressure resistance and hull vibration, which is capable of giving a pleasant voyage environment to crews and passengers of a ship by reducing vibration caused by a ship propeller and capable of saving fuel by enhancing propulsive efficiency of the ship.

BACKGROUND ART

In the present day, freight has been transported rapidly over the world with the development of transportation means such as aircraft. However, in the case of oil, natural gas, vehicles, and containers with a very large freight volume and a heavy freight weight, they could not be transported in great volumes at a time by the aircraft and, therefore, it is common to transport them by a ship.

In the event that freight is transported by using a ship, it is required to make the ship large and move at high speed in order to transport a great amount of freight at a time and rapidly. However, hull vibration is increased by a ship propeller and a lot of fuel is consumed due to an increase of an engine horsepower resulting from the large ship moving at a high speed.

Therefore, there is a need for the development of a device which can reduce hull vibration by the ship propeller and save fuel even when the horsepower of the engine is increased.

Figure 2:
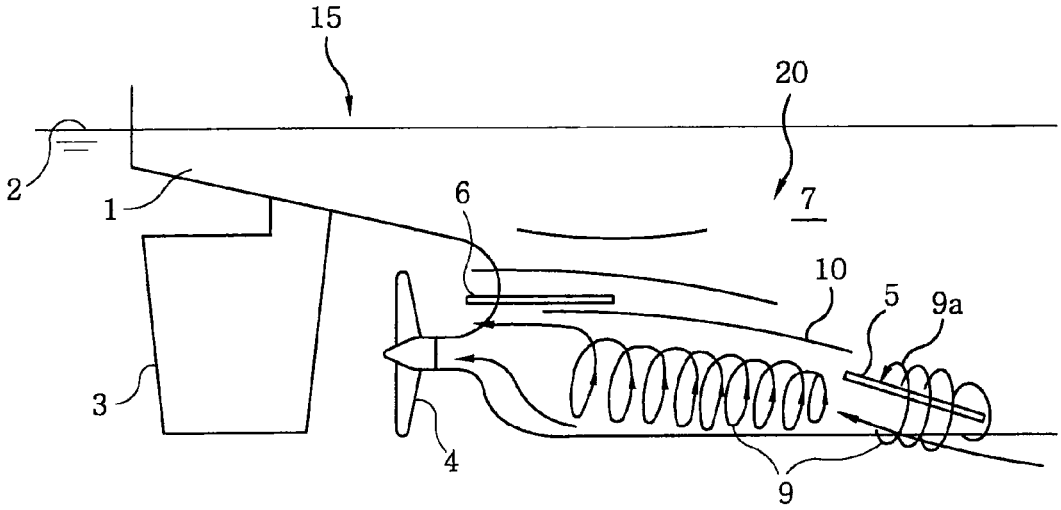
FIG. 2 (PRIOR ART)
FIG. 2 is a schematic side view illustrating the flow of a fluid, which is controlled by the fin device of the conventional ship.
Figure 1:
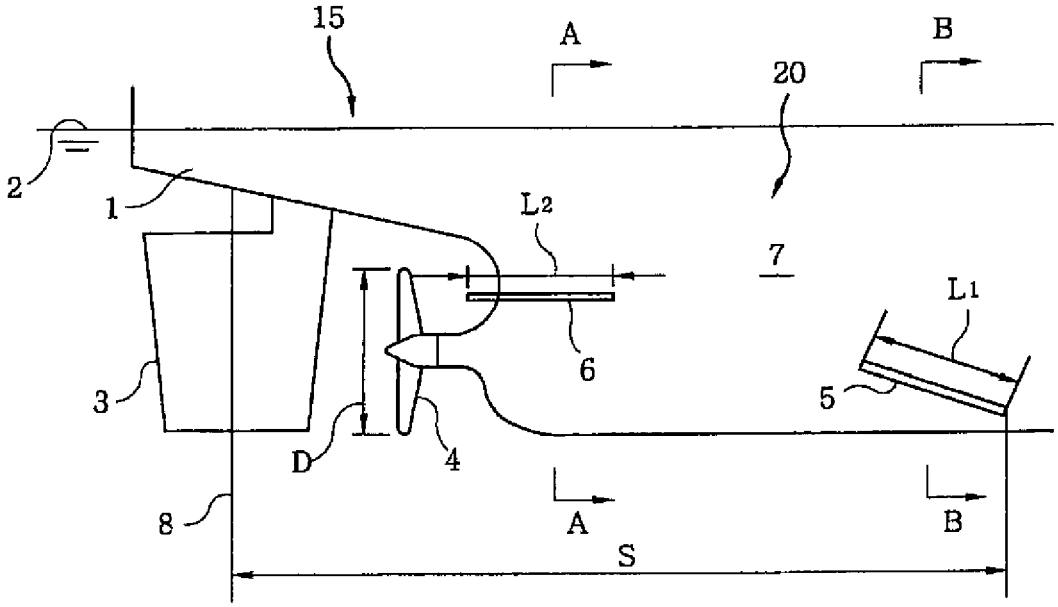
FIG. 1 (PRIOR ART)
Figure 2:
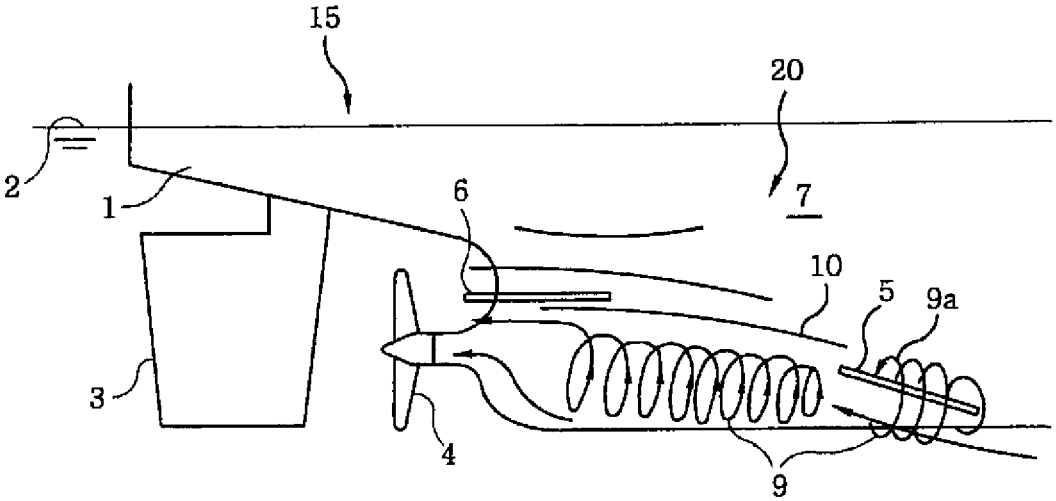
FIG. 2 (PRIOR ART)

FIG. 1 is a schematic side view of a conventional fin device of a ship. FIG. 2 is a schematic side view illustrating the flow of a fluid, which is controlled by the conventional fin device of the ship. FIG. 3 illustrates the comparison of the speed of a fluid flowing into the propeller of the ship provided with the fin device shown in FIG. 1 with the speed of a fluid flowing into the propeller of a bare hull provided with no fin device. FIG. 4 illustrates the comparison of constant pressure lines of the ship provided with the fin device shown in FIG. 1 with constant pressure lines of the bare hull.

The conventional fin device of the ship is disclosed in Japanese Patent Laid-Open Publication No. 2002-362485, and was contrived to improve propulsive efficiency and reduce resistance of a ship body.

The fin device of the ship includes two fins 5 and 6 which are respectively provided on the front and rear sides. Both the fins 5 and 6 are mounted to an outer plate of the ship body so as to protrude at an almost right angle, and have a thin thickness.

The front fin 5 has an installation starting point at a location of a distance S (within 15% of Lbp) on the bow side from a vertical line 8 of the stern, and is installed under the central height of a propeller 4. The front fin 5 is inclined such that its height from the bottom of the ship increases as it goes toward the stern. The front fin 5 has a length L1 smaller than the diameter D of the propeller 4. A protruding width of the front fin 5 from the ship body is smaller than 10% of the diameter D of the propeller 4.

The rear fin 6 is disposed in parallel to the bottom of the ship between the centerline of the propeller 4 and a propeller tip, and is installed right ahead of the propeller. The rear fin 6 has a length L2 smaller than the diameter D of the propeller 4.

A protruding width of the rear fin 6 from the ship body is smaller than 20% of the diameter D of the propeller 4.

The front fin 5 serves to weaken a vortex (bilge vortex) 9 which spirals from the bottom of the ship to the side of the ship, and also sequentially guide the vortex toward the propeller. The rear fin 6 serves to prevent diffusion of the bilge vortex 9 which is guided toward the propeller 4 by the front fin 5. The flow of a fluid 10, which flows through a gap between the front fin 5 and the rear fin 6, serves to prevent diffusion of the bilge vortex 9.

If the bilge vortex 9 is weakened as described above, the fluid flown into the propeller becomes more uniform. If diffusion of the bilge vortex 9 is prevented, induction resistance caused by the bilge vortex 9 is decreased. Thus, resistance of the ship body can be reduced and propulsive efficiency of a ship can be improved.

The present inventors performed a numerical analysis in order to confirm the conventional effects. The results of the numerical analysis are shown in FIGS. 3 and 4.

FIG. 3(*a*) shows the speed of a fluid flowing into the propeller of a bare hull provided with no fin device, and FIG. 3(*b*) shows the speed of a fluid flowing into the propeller of a ship provided with the fin device shown in FIG. 1. In FIG. 4, lines indicated as prior art show the constant pressure lines of the ship provided with the fin device, and lines indicated as bare hull show the constant pressure lines of the bare hull. In FIG. 4, the closer toward the stern, the larger the constant pressure line.

The present inventors set an attachment condition of the fin within a range of the embodiment disclosed in Japanese Patent Laid-Open Publication No. 2002-362485 in performing the numerical analysis.

The front fin 5 was disposed at the location of 15% of Lbp from the perpendicular line A.P. of the stern in the length direction of the ship and mounted at the location of 30% of the diameter of the propeller from the bottom of the ship in the height direction of the ship. Further, the length of the front fin 5 was set to the same as the propeller diameter, the width of the front fin 5 was set to 7% of the propeller diameter, and an angle of the front fin 5 to the bottom of the ship was set to 10 degrees. Furthermore, the rear fin 6 was mounted right in front of the propeller in the length direction of the ship, and at the location of 90% of the propeller diameter from the bottom of the ship in the height direction of the ship. The length of the rear fin 6 was set to 80% of the propeller diameter, the width of the rear fin 6 was set to 10% of the propeller diameter, and the rear fin 6 was set in parallel to the bottom of the ship.

When performing a numerical analysis under the above conditions, it can be seen from FIG. 3 that there is almost no speed change at the lower side of the propeller in the speed of a fluid flowing into the propeller of the ship provided with the fin device shown in FIG. 1 compared with the speed of a fluid flowing into the propeller of the bare hull provided with no fin device. It can also be seen that there are speed-reduced portions at the upper side of the propeller with the fin device shown in FIG. 1. It means that the effect of reducing vibration by the propeller of the ship provided with the fin device shown in FIG. 1 rarely appears.

Further, from FIG. 4, it can be seen that the constant pressure lines of the ship provided with the fin device shown in FIG. 1 are almost identical to those of the bare hull and, therefore, pressure resistance is rarely decreased. It can also be seen that propulsive efficiency of the ship is not much improved since pressure resistance is not reduced as described above.

DISCLOSURE OF INVENTION

Technical Problem

It is, therefore, an object of the present invention to provide a flow control device for improving pressure resistance and hull vibration, which is capable of reducing vibration caused by a ship propeller and also resistance of a ship body by preventing a bilge vortex from flowing into the ship propeller, and reducing vibration caused by the ship propeller by accelerating the flow of a fluid flowing into upper and lower sides of the ship propeller.

Technical Solution

In accordance with an aspect of the present invention, there is provided a flow control device for improving pressure resistance and hull vibration, the apparatus including: a lower fin disposed between 2 station and 4 station in a length direction of a ship and between 10% and 20% of a design draft from a bottom of the ship in a height direction of the ship, the lower fin being inclined at an angle of 20 degrees to 40 degrees with respect to a design draught (or base) line; and an upper fin disposed between the 2 station and the 4 station in the length direction of the ship and between 30% and 60% of the design draft from the bottom of the ship in the height direction of the ship, the upper fin being inclined at an angle of 10 degrees to 30 degrees with respect to the design draught (or base) line.

Preferably, the flow control device further includes an additional fin disposed between 1 station and 3 station in the length direction of the ship and between 5% and 20% of the design draft from the bottom of the ship in the height direction of the ship, the additional fin being inclined at an angle of 10 degrees to 40 degrees with respect to the design draught (or base) line.

The lower fin generates a new vortex. The new vortex changes the path of a bilge vortex through an interaction with the bilge vortex, preventing the bilge vortex from flowing into the propeller. The new vortex also makes slow the velocity of a fluid over the propeller plane, improving resistance performance. The upper fin and the additional fin accelerate the velocity of a fluid flowing into the propeller, decreasing vibration caused by the propeller. In particular, the upper fin further makes straight a smooth line on the surface of the ship body, helping to improve resistance performance.

The upper fin, the lower fin and the additional fin may be formed in a rectangular, trapezoidal or triangular shape.

Preferably, the upper fin, the lower fin and the additional fin each have a thickness of 20 mm to 100 mm, a width ranging from 0.1% to 0.5% of a ship length, and a length ranging from 0.3% to 3% of the ship length.

In accordance with another aspect of the present invention, there is provided a ship provided with the flow control device as described above.

ADVANTAGEOUS EFFECTS

In accordance with the present invention, vibration caused by the ship propeller can be reduced by only attaching simple fins. Accordingly, a pleasant voyage environment of crews and passengers can be obtained and fuel can be saved through the improvement of propulsive efficiency of the ship.

BRIEF DESCRIPTION OF THE DRAWINGS

The above and other objects and features of the present invention will become apparent from the following description of preferred embodiments given in conjunction with the accompanying drawings, in which:

FIG. 1 is a schematic side view of a conventional fin device of a ship;

FIG. 2 is a schematic side view illustrating the flow of a fluid, which is controlled by the conventional fin device of the ship;

FIG. 3 illustrates the comparison of the speed of a fluid flowing into a propeller of a ship provided with the fin device shown in FIG. 1 with the speed of a fluid flowing into a propeller of a bare hull provided with no fin device;

FIG. 4 illustrates the comparison of constant pressure lines of the ship provided with the fin device shown in FIG. 1 and constant pressure lines of the bare hull;

FIG. 5 is a schematic side view of a ship provided with a flow control device for improving pressure resistance and hull vibration in accordance with an embodiment of the present invention;

FIG. 6 is a partial plan view of the ship provided with the flow control device shown in FIG. 5;

FIG. 7 illustrates the comparison of the speed of a fluid flowing into a propeller of the ship provided with the flow control device shown in FIG. 5 with the speed of a fluid flowing into a propeller of a bare hull provided with no flow control device;

FIG. 8 illustrates the amount of cavities included in a unit volume, which are changed by the speeds of the fluid shown in FIG. 7;

FIG. 9 illustrates the comparison of constant pressure lines of the ship provided with the flow control device shown in FIG. 5 with constant pressure lines of the bare hull; and FIG. 10 illustrates the comparison of effective horsepower of the ship provided with the flow control device shown in FIG. 5 with effective horsepower of the bare hull.

BEST MODE FOR CARRYING OUT THE INVENTION

Hereinafter, an embodiment of the present invention will be described in detail with reference to the accompanying drawings.

FIG. 5 is a schematic side view of a ship provided with a flow control device for improving pressure resistance and hull vibration in accordance with an embodiment of the present invention; and FIGS. 6A to 6C are partial plan views of the ship provided with the flow control device shown in FIG. 5.

In the present embodiment, an upper fin 102 is located between 2 station and 4 station in the length direction (X-axis direction) of a ship 100, and at a height H1 between 30% and 60% of a design draft from the bottom 108 of the ship in the height direction (Z-axis direction) of the ship 100. The upper fin 102 is inclined at an angle D1 of 10 to 30 degrees with respect to a design draught (or base) line 110.

A lower fin 104 is located between the 2 station and the 4 station in the length direction (X-axis direction) of the ship 100, and at a height H2 between 10% and 20% of the design draft from the bottom 108 of the ship in the height direction (Z-axis direction) of the ship 100. The lower fin 104 is inclined at an angle D2 of 20 to 40 degrees with respect to the design draught (or base) line 110.

An additional fin 106 is located between 1 station and 3 station in the length direction (X-axis direction) of the ship 100, and at a height H3 between 5% and 20% of the design draft from the bottom 108 of the ship in the height direction (Z-axis direction) of the ship 100. The additional fin 106 is attached at an angle D3 of 10 to 40 degrees with respect to the design draught (or base) line 110.

In this case, the term station means the longitudinal positions in case a LBP is divided into twenty sections equally.

Station numbers are assigned beginning with an after perpendicular line. The station number of the first station is 0 and the station number of the last station is 20. The LBP refers to a distance between a forward perpendicular line and an after perpendicular line. The forward perpendicular line F.P refers to an imaginary line passing through an intersection point between a design draught line and the front of the stern and is perpendicular to the design draught line. The after perpendicular line A.P refers to an imaginary vertical line passing through an intersection point between the back of a rudder post and a design draught line in case of a ship having the rudder post, or an imaginary vertical line passing through an intersection point between the center line of a rudder stock and a design draught line in case of a ship having no rudder post.

The upper fin 102, the lower fin 104, and the additional fin 106 are formed in a rectangular, trapezoidal or triangular shape, and they may have the same shape or different shapes. They are attached to both sides of the ship in a symmetrical manner.

Thicknesses T1, T2, and T3 of the upper fin 102, the lower fin 104 and the additional fin 106 each range from 20 mm to 100 mm. The upper fin 102, the lower fin 104 and the additional fin 106 have a width in a range from 0.1% to 0.5% of the length of the ship 100. Lengths L1, L2, and L3 of the upper fin 102, the lower fin 104 and the additional fin 106 each range from 0.3% to 3% of the ship 100. In this case, the width refers to the height of the fins 102, 104, and 106 protruding from the surface of the ship body.

The upper fin 102 serves to accelerate the flow of a fluid flowing into an upper portion of the propeller, and the additional fin 106 serves to accelerate the flow of a fluid flowing into a lower portion of the propeller. In particular, the upper fin 102 and the additional fin 106 serves to make straight a smooth line on the surface of the ship body, helping to improve resistance performance. If the flow of the fluid flowing into the propeller becomes fast, a cavity phenomenon (cavitation) is less generated in the blades of the propeller. Thus, fluctuating pressure of the ship body is decreased and vibration of the ship body is reduced accordingly. The cavitation phenomenon refers to a phenomenon in which surrounding pressure drops below a steam pressure at a specific temperature and a liquid state is changed to a gaseous state.

The lower fin 104 has an angle greater than a flow angle of the smooth line with respect to the bottom of the ship 108, thus generating a vortex. The vortex interacts with a vortex that spirals from the bottom of the ship to the side thereof (i.e., a bilge vortex), guiding the bilge vortex to flow upwardly above the propeller. Thus, the bilge vortex is not flown into the propeller side. If the bilge vortex (i.e., an unstable vortex) is not flown into the propeller blades, slipstream in the propeller blades becomes uniform and fluctuating pressure of the ship body can be reduced, decreasing vibration of the ship body.

Further, the bilge vortex, guided to the region above of the propeller by the lower fin 104, serves to make slow the velocity of a fluid flowing through the region above of the propeller, increasing a pressure in the region above of the propeller. The increased pressure in the region above of the propeller functions as force to propel the ship body forwardly. Consequently, pressure resistance of the ship body is decreased.

FIG. 7 Ilustrates the comparison of the speed of a fluid flowing into a propeller of the ship provided with the flow control device shown in FIG. 5 with the speed of a fluid flowing into a propeller of a bare hull provided with no flow control device; FIG. 8 illustrates the amount of cavities included in a unit volume, which are changed by the speeds of the fluid shown in FIG. 7; FIG. 9 illustrates the comparison of constant pressure lines of the ship provided with the flow control device shown in FIG. 5 with constant pressure lines of the bare hull; and FIGS. 10A and 10B illustrates the comparison of effective horsepower of the ship provided with the flow control device shown in FIG. 5 with effective horsepower of the bare hull.

The present inventors have performed a simulation test in a towing tank in order to demonstrate the effects of the present embodiment. In the simulation test, the block coefficient of a ship was set to 0.81. The upper fin 102 was attached to the 3 station in the X-axis direction and placed at a height, which is 40% of the design draft from the bottom of the ship 108 in the Z-axis direction, and inclined at an angle of 18.5 degrees with respect to the design draught (or base) line 110. Further, the lower fin 104 was attached to the 3 station in the X-axis direction and placed at a height, which is 15% of the design draft from the bottom of the ship 108 in the Z-axis direction, and inclined at an angle of 32 degrees with respect to the design draught (or base) line 110. The additional fin 106 was attached to the 2 station in the X-axis direction and placed at a height, which is 10% of the design draft from the bottom of the ship 108 in the Z-axis direction, and inclined at an angle of 23 degrees with respect to the design draught (or base) line 110. The fins 102, 104, and 106 were formed in a rectangular shape, lengths L1, L2 and L3 thereof were respectively set to 1% of the LBP, and a width W thereof was set to 0.2% of the LBP.

The results of the simulation test and a numerical analysis under the above conditions are shown in FIGS. 7 to 10.

FIG. 7 illustrates the axial velocity distribution of a fluid flowing into the propeller. FIG. 7(*a*) shows an example of a bare hull provided with no flow control device, and FIG. 7(*b*) shows an example of a ship provided with the flow control device of the present embodiment.

When comparing FIGS. 7(*a*) and 7(*b*), it can be seen that the velocity of a fluid flowing into the upper portion of the propeller is in a range of 0.4 to 0.5 as indicated in FIG. 7(*a*), whereas the velocity of a fluid flowing into the propeller is in a range of 0.65 to 0.85 as indicated in FIG. 7(*b*). It can also be seen that a portion in which the velocity of the fluid flowing into the lower portion of the propeller is becomes fast from 0.7 of FIG. 7(*a*) to 0.9 of FIG. 7(*b*).

If the velocity of the fluid flowing into the propeller becomes fast as described above, vibration caused by the propeller is decreased. The results are shown in FIG. 8.

In FIG. 8, a horizontal axis indicates a rotation angle in a clockwise direction (a positive value) on the basis of the 12 o clock direction and a rotation angle in a counterclockwise direction (a negative value) when the propeller is viewed from the back of the ship body, and a vertical axis indicates cavities included in a unit volume.

In FIG. 8, a thin line corresponds to a value in case of the bare hull and a thick line corresponds to a value in case of the present embodiment. From the two values, it can be seen that the amount of cavities included in the unit volume is less in the case of the present embodiment than in the case of the bare hull. If the amount of the cavities is decreased, vibration due to the propeller is reduced. Consequently, it can be understood that vibration caused by the propeller is reduced in the case of the present embodiment than in the case of the bare hull.

FIG. 9 illustrates constant pressure lines on the surface of the ship body. In FIG. 9, lines indicated by a thick arrow correspond to constant pressure lines in the case of the present embodiment, and lines indicated by a dot arrow correspond to constant pressure lines in the case of the bare hull. As the constant pressure line approaches the stern, it has a greater value.

From FIG. 9, it can be seen that, with respect to a point, a pressure at the point is greater in the case of the present embodiment than in the case of the bare hull. Portions where the difference between the two cases is significantly great are indicated by circular dotted lines.

If the pressure at the rear of the ship body increases, the pressure functions as force to push the ship toward the bow. Consequently, there is an effect of reducing pressure resistance. If pressure resistance is decreased as described above, propulsive efficiency of the ship can be improved. The results are shown in FIG. 10.

FIGS. 10A and 10B illustrate effective horsepower of a ship. In FIGS. 10A and 10B, a horizontal axis indicates the speed of the ship, a vertical axis indicates effective horsepower of the ship, a solid line indicates an example of the present embodiment, and a dotted line indicates an example of the bare hull.

From FIGS. 10A and 10B, it can be seen that in order to move forward the ship at a speed of about 15.5 knots, horsepower of 18000 PS is needed in the case of the present embodiment, whereas horsepower of 19000 PS is needed in the case of the bare hull. In other words, it could be seen that effective horsepower of about 5% was improved.

In accordance with the present invention, vibration caused by the ship propeller can be reduced by only attaching simple fins. Accordingly, a pleasant voyage environment of crews and passengers can be obtained and fuel can be saved through the improvement of propulsive efficiency of the ship.

While the invention has been shown and described with respect to the preferred embodiments, it will be understood by those skilled in the art that various changes and modifications may be made without departing from the spirit and scope of the invention as defined in the following claims.

The invention claimed is:

1. A flow control device for improving pressure resistance and hull vibration, the apparatus comprising:

a lower fin disposed between 10% and 20% from an after perpendicular line in a length direction of a ship and between 10% and 20% of a design draft from a bottom of the ship in a height direction of the ship, the lower fin being inclined at an angle of 20 degrees to 40 degrees with respect to a design draught (or base) line;

an additional fin disposed between 5% and 15% from the after perpendicular line in the length direction of the ship and between 5% and 20% of the design draft from the bottom of the ship in the height direction of the ship, the additional fin being inclined at an angle of 10 degrees to 40 degrees with respect to the design draught (or base) line; and an upper fin disposed between 10% and 20% from the after perpendicular line in the length direction of the ship and between 30% and 60% of the design draft from the bottom of the ship in the height direction of the ship, the upper fin being inclined at an angle of 10 degrees to 30 degrees with respect to the design draught (or base) line;

wherein the upper fin, the lower fin and the additional fin are formed in a rectangular, trapezoidal or triangular shape; and wherein the upper fin, the lower fin and the additional fin each have a thickness of 20 mm to 100 mm, a width ranging from 0.1% to 0.5% of a ship length, and a length ranging from 0.3% to 3% of the ship length.

2. A ship comprising the flow control device described in claim 1.

* * * * *